US009790064B2

(12) United States Patent
Timmermans

(10) Patent No.: US 9,790,064 B2
(45) Date of Patent: Oct. 17, 2017

(54) AUTONOMOUS WINCH WITH GRIP PULLEY

(71) Applicant: Capital Access S.A., Steinsel (LU)

(72) Inventor: Francis Timmermans, Steinsel (LU)

(73) Assignee: Capital Access S.A., Steinsel (LU)

( * ) Notice: Subject to any disclaimer, the term of this patent is extended or adjusted under 35 U.S.C. 154(b) by 0 days.

(21) Appl. No.: 15/030,984

(22) PCT Filed: Oct. 27, 2014

(86) PCT No.: PCT/EP2014/073034
§ 371 (c)(1),
(2) Date: Apr. 21, 2016

(87) PCT Pub. No.: WO2015/063043
PCT Pub. Date: May 7, 2015

(65) Prior Publication Data

US 2016/0297651 A1 Oct. 13, 2016

(30) Foreign Application Priority Data

Oct. 28, 2013 (LU) ..... 92298

(51) Int. Cl.
*B66D 1/74* (2006.01)
*A63B 29/00* (2006.01)
*A63B 29/02* (2006.01)

(52) U.S. Cl.
CPC ..... *B66D 1/7415* (2013.01); *A63B 29/00* (2013.01); *B66D 1/7489* (2013.01); *A63B 29/02* (2013.01)

(58) Field of Classification Search
CPC .... B66D 1/7489; B66D 1/7415; A63B 29/00; A63B 29/02
See application file for complete search history.

(56) References Cited

U.S. PATENT DOCUMENTS 3,797,608 A * 3/1974 Virdis ..... B66D 1/7415 182/112
3,944,185 A * 3/1976 Evans ..... B66D 1/7415 187/265

(Continued)

FOREIGN PATENT DOCUMENTS

EP 0876987 A1 11/1998
EP 1030726 A1 8/2000

(Continued)

OTHER PUBLICATIONS

International Search Report issued May 30, 2014 in corresponding PCT/EP2014/073034; 10 pgs.

(Continued)

*Primary Examiner* — Sang Kim
*Assistant Examiner* — Nathaniel Adams
(74) *Attorney, Agent, or Firm* — Maier & Maier, PLLC

(57) ABSTRACT

Winch with a grip pulley for moving along a lifting strand, in particular a rope or cable, including a frame; a drive pulley with a single groove mounted on said frame; a guide means capable of guiding the lifting strand under tension from the upper region of said frame towards the lower region thereof, the guide means comprising on the lower region side of said frame a guide pulley close to the drive pulley and transferring the taut lifting strand onto the drive pulley; a clamping pulley, close to said guide pulley, exerting pressure on the lifting strand towards said drive pulley and acting on the wrapped end of the lifting strand on said pulley on the free strand side.

17 Claims, 3 Drawing Sheets

(56) References Cited

Figure 1:
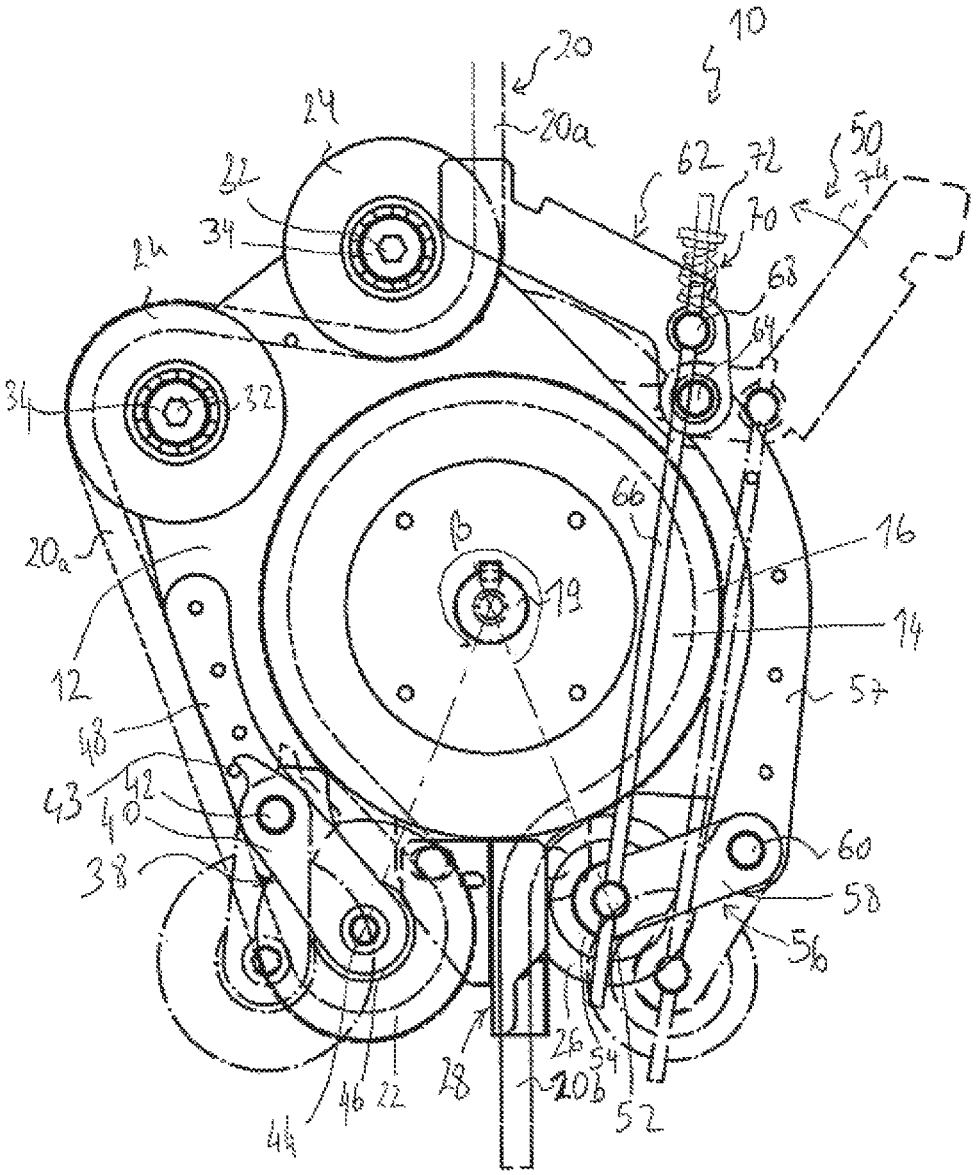

U.S. PATENT DOCUMENTS 3,949,969 A * 4/1976 Kaufer ..... B66D 1/7415 254/296
4,139,178 A * 2/1979 Hippach ..... B66D 1/7415 187/265
4,205,871 A * 6/1980 Manabe ..... B66D 1/7415 254/333
4,293,121 A * 10/1981 Wallin ..... B66D 1/7415 254/217
4,316,602 A * 2/1982 Desplats ..... B66D 1/7415 104/173.1
4,359,139 A * 11/1982 Bloder ..... A62B 1/10 182/234
4,555,091 A * 11/1985 May ..... B66D 1/7415 188/65.1
4,611,787 A * 9/1986 May ..... B66D 1/7415 254/267
4,620,615 A * 11/1986 Morris ..... B66B 15/04 187/264
4,706,940 A * 11/1987 Harig ..... B66D 1/7415 226/190
5,129,626 A * 7/1992 Koludzki ..... B66D 1/7415 254/333
5,626,081 A * 5/1997 Kuryu ..... B66D 1/7415 104/191
6,009,979 A * 1/2000 Kim ..... A62B 1/10 182/142
6,412,602 B1 * 7/2002 Sundman ..... A62B 1/14 182/133
7,513,334 B2 * 4/2009 Calver ..... B66D 1/7415 182/133

FOREIGN PATENT DOCUMENTS

GB 2055735 A 3/1981
GB 2057871 A 4/1981
WO 2010/049597 A1 5/2010
WO 2012/157954 A2 11/2012

OTHER PUBLICATIONS

Written Opinion issued May 7, 2015 in corresponding PCT/EP2014/073034; 5 pgs.
International Preliminary Report on Patentability and the Written Opinion of the Search Authority dated May 12, 2016, in connection with corresponding PCT Application No. PCT/EP2014/073034 (15 pgs.).

* cited by examiner

AUTONOMOUS WINCH WITH GRIP PULLEY

FIELD OF THE INVENTION

The present invention relates to a winch for moving along a lifting strand such as a rope or cable, and in particular a winch to which a user may attach him/herself to move up and down along a rope.

BACKGROUND OF THE INVENTION

The invention relates to the field of winches and in particular grip pulley winches. Grip pulley winches should not be confused with drum winches or the like. This is because winches with a grip pulley have the characteristic of being usable with cables of unlimited length due to the selected principle of gripping the cable within a single groove of the grip pulley in which the cable is wrapped around at least one turn.

Such winches have been developed for professional, safety and sporting purposes: access to building façades, masts for wind turbines or ships, working areas in lift shafts or silos, mountain rescue and climbing, etc. They have the following advantages over other winches:

no height limit the winch can move along the cable and therefore accompany the load, whether this is an object or a user.

EP 1 030 726 for example describes a grip winch comprising a motor, the drive shaft of which is coupled to a pulley with a single V groove, mounted on a frame. The winch comprises a locking member attached to the frame which allows the winch to climb the rope and locks as soon as the climbing force ceases. A guide ring is positioned above and close to the pulley. The rope is placed by the user in such a way as to pass through the guide ring, wrap around the pulley and pass once more through the same guide ring, the rope therefore being engaged around 180° in the pulley groove. The design of the pulley part of this winch, with a contact angle of 180°, entails the need for a locking member. Another disadvantage is associated with the taut strand and the slack strand necessarily passing through the guide ring, which involves the rope entering and exiting via the top of the winch. In the case of a rope, which does not have the longitudinal stiffness of a cable, upwards extraction may prove problematic and cause jamming.

Other devices using grooved pulleys for hauling may be cited. Le GB 2057871 describes, for example, a life-saving device for lowering people by abseiling comprising a frame, to be attached to the person to be lowered, and a grooved pulley for the cable, the latter being guided around the pulley over an angle of greater than 180 degrees. The pulley is braked by a mechanism which takes account of the person's weight.

GB 2057871 describes a winch of the boat winch type, for hauling sails. EP0876987 describes an emergency lift system intended to be installed on the outside of a building. WO2010049597 describes a self-blocking, anti-panic and position-locking belaying/descending device.

OBJECT OF THE INVENTION

The object of the present invention is that of proposing an improved winch which does not have the above-stated disadvantages.

General Description of the Claimed Invention with the Main Advantages Thereof According to the invention, said object is achieved by a winch with a grip pulley for a lifting strand comprising:

a front frame having, in service, an upper region facing towards a portion of the lifting strand under tension and a lower region on the slack side of the lifting strand;

a grip pulley mounted on the frame and comprising on the periphery thereof a groove enabling the lifting strand to be hauled (transmission of force/movement) by grip;

a guide means capable of guiding the lifting strand under tension from the upper region of the frame towards the lower region thereof, the guide means comprising on the lower region side of the frame a guide pulley close to the grip pulley and guiding the lifting strand to enter the grip pulley;

a clamping pulley on exit from the grip pulley, close to the guide pulley, exerting pressure on the lifting strand towards the grip pulley.

The winch according to the invention enables ascent and descent along a lifting strand of unlimited length (the term lifting strand is here used to denote a rope, in particular a synthetic rope, a cable, etc.). It will be appreciated that the design of the winch has been particularly intended for ropes, which results in the slack strand exiting downwards, and overcomes the tendency towards jamming, at variance with winches in which the slack strand exits via the top.

Furthermore, the design of the winch according to the invention, which uses a grip pulley in combination with a clamping pulley, permits forces to be controlled in such a manner as to ensure locking of the rope in the grip pulley in the absence of drive, so removing the need for a specific locking member. The proximity of the guide and clamping pulleys furthermore permits a large wrap angle of the lifting strand on the pulley, so increasing the lifting force.

The guide pulley and the clamping pulley are preferably positioned in such a manner that the lifting strand is engaged in the groove of the grip pulley over an angle of at least 200°, preferably at least 280° and more preferably between 300 and 340°.

In order to be driven, the grip pulley is preferably mounted on a shaft coupled to a manual or motor-powered drive mechanism, generally via a reducing gearbox. The motor may be an electric motor or heat engine.

The motor control makes it possible to cause the grip pulley to rotate in both directions of rotation, so enabling the user to control the ascent and descent of the winch on the lifting strand.

The design of the winch furthermore permits great compactness which therefore suits it for use as an autonomous portable unit, the bulk of which will still be dependent on the drive mechanism.

The winch advantageously comprises an anchoring point which, depending on the application, will serve to attach a flexible link or a rigid structure capable of supporting a user or a filler.

The clamping pulley is preferably forced towards the grip pulley by a resilient means, in particular a compression spring.

The guide and clamping pulleys are preferably retractable, which makes it possible to wrap the rope around the grip pulley on a continuous portion of the rope (and not just at the end of the rope).

According to one variant, the clamping pulley is carried by an arm mounted pivotably on the frame about a pin and cooperates with a toggle lever type mechanism for locking the clamping pulley into a working position against the lifting strand.

The drive pulley is preferably of the type having a V groove. Grip may be improved by a relief pattern on the sidewalls of the groove.

In practice, the rope and the grip pulley are selected to suit one another. In order to limit wear, a pulley with a wrap diameter of at least 150 mm will be selected with a wrap coefficient of the order of 14 to 18 being desirable.

DETAILED WITH REFERENCES TO THE FIGURES

Figure 2:
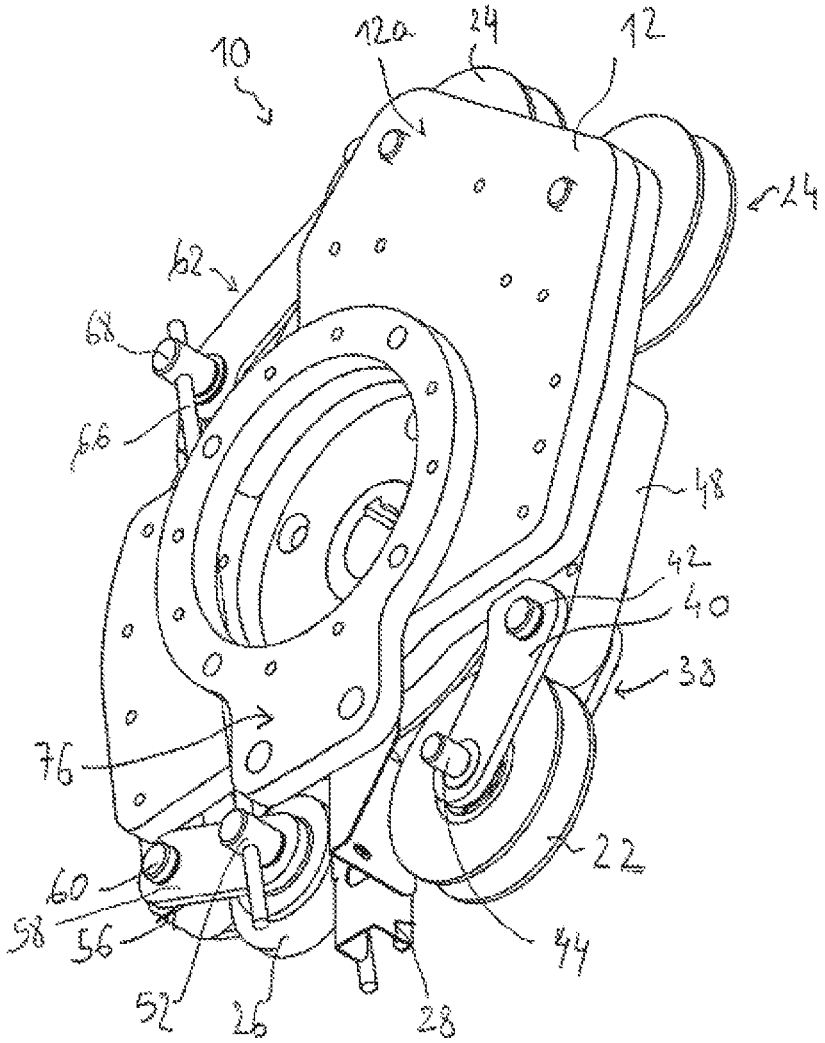
Figure 3:
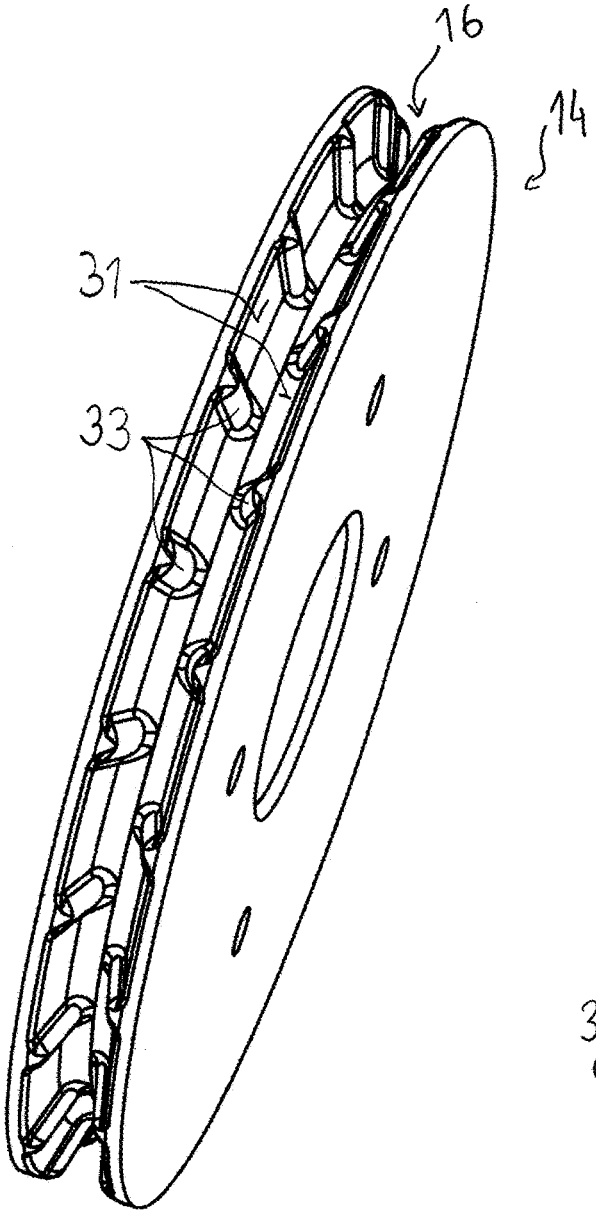
Figure 4:
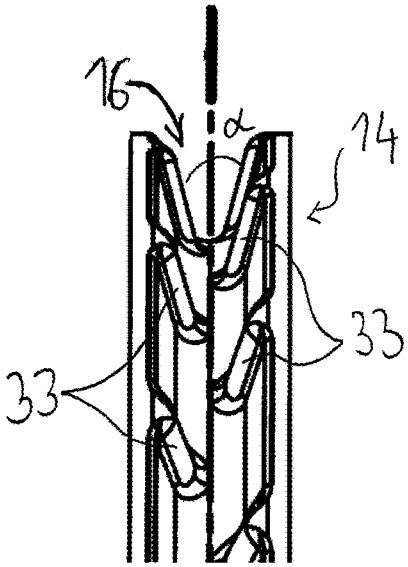
Figure 5:
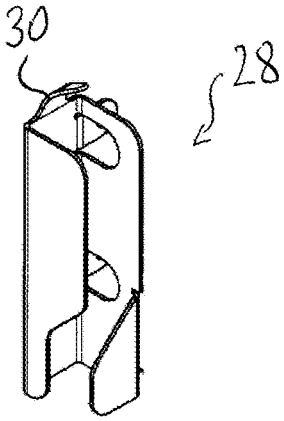

Other details and features of the invention will emerge from the following detailed description of at least one embodiment, provided by way of illustration with reference to the appended drawings, in which:

FIG. 1: is a side view of one embodiment of the present winch;

FIG. 2: is a perspective rear view of the winch of FIG. 1;

FIG. 3: is a perspective view of the grip pulley;

FIG. 4: is a detail view of the groove of the pulley of FIG. 3;

FIG. 5: is a perspective of the rope guide.

In the figures, the same reference signs denote identical or similar elements.

FIG. 1 shows a side view of a variant embodiment of the present winch 10. It comprises a frame 12 on which is mounted a grip pulley 14 (also denoted drive pulley) comprising on the periphery thereof a (single) groove 16 which allows a lifting strand, in particular of a synthetic rope, which bears the reference numeral 20 and takes the form of broken lines in the drawings, to be driven by grip. For the purpose of rotation, the grip pulley 14 is attached to a shaft 19 to which it is connected for rotation. The shaft 19 is generally part of a drive means coupled to the pulley 14 via said shaft, as will be seen below.

FIG. 1 shows the winch 10 in the service/working position thereof, in which it may be seen that the taut strand 20*a* of the rope 20 arrives from the top of the winch 10 (the opposite end of the taut strand being attached to a support), while the slack strand 20*b* leaves downwards. The taut strand 20*a* thus arrives from upper region side of the frame 12, whereas the slack strand 20*b* exits from the lower region side of the frame 12.

A guide means is provided to guide the rope 20 under tension from the upper region of the frame towards the lower region thereof and comprises a guide pulley 22 which preferably cooperates with at least one deflection pulley 24, in this case two deflection pulleys. The (freely rotating) deflection pulleys 24 are positioned in the upper part of the frame 12, above the grip pulley 14, to receive the taut strand 20*a* and deflect it laterally towards the guide pulley 22 which is positioned in the lower part, below and close to the drive pulley 14.

The strand of rope 20*a* under tension arriving from the top passes via the deflection pulleys 24 to arrive at the guide pulley 22, which further directs the taut strand 20*a* upwards and transfers it towards the drive pulley 14. The rope 20 then forms a loop around the pulley 14 and exits from the latter behind a clamping pulley 26 which exerts a pressure on the rope 20 towards the bottom of the groove 16.

After the clamping pulley 26, the rope 20 falls downwards by gravity; this is the slack strand 20*b*. A guide 28 is preferably located directly behind the clamping pulley 26 to guide the rope 20 downwards when it exits from the groove 16. In the present variant, the guide 28 is a square-section channel which is partially open to the side, one end of which is close to the grip pulley 14. The guide 28 preferably comprises a curved finger 30 which extends from the upper end thereof partially into the groove 16 of the grip pulley to facilitate extraction of the rope 20. The guide 28 thus enables extraction of the slack strand 20*b* out of the winch. There is no need to ballast the slack strand with a weight to extract it from the grip pulley 14.

In such a grip pulley 14 winch, the hauling force depends on the wrap angle of the rope in the groove of the grip pulley and the coefficient of grip of the rope in the groove, as well as on the force exerted by the clamping pulley 26 on exit from the grip pulley. Appropriate sizing of the pulley 14 and of the clamping pulley 26, taking account of the service load, therefore makes it possible to produce a winch which has a sufficient lifting force and does not require an additional brake at standstill. In practice, in accordance with standard EN-1808, the winch is calculated to prevent any rope slippage when raising or lowering a load of greater than or equal to 1.5 times the maximum working load.

In order to improve the grip of the rope in the groove, the walls 31 of the latter are preferably V-shaped. Grip is further increased by protuberances, in this case radial ribs 33 in a staggered arrangement on the opposing sidewalls of the groove 16. As can be seen, the ribs are distributed regularly on each of the sidewalls, and the ribs on one sidewall face the middle of the gap between ribs of the other sidewall.

Grip is further controlled by appropriate groove/rope sizing, the bottom of the groove having a diameter slightly less than that of the rope, for example 0.7 to 0.9, preferably between 0.7 and 0.8, times the diameter of the rope. The aperture angle of the groove (denoted alpha in FIG. 4) may be selected between 15 and 35°, preferably between 20 and 30°. The thickness of the protuberances may also be adjusted.

Another parameter which influences hauling force is the wrap angle, here denoted $\beta$, over which the rope is engaged in the groove 16 of the drive pulley 14. It is the respective positions of the guide pulleys 22 and clamping pulleys 26 which determine said angle $\beta$. Angle $\beta$ is greater than 200°, preferably greater than 280° and in particular between 300 and 340°. As can be seen in FIG. 1, the clamping and guide pulleys are positioned close to one another, separated by the guide 28, so enabling a large wrap angle $\beta$ of the order of 320°.

The various parameters influencing grip will be sized with care since they are also factors in rope wear. Preferably, a wrap coefficient (ratio of wrap diameter to rope diameter) of the order of 14 to 18 with a pulley having a wrap diameter of at least 150 mm will be desirable.

As can be seen in FIGS. 1 and 2, the present winch 10 is compact, the various pulleys being mounted on the frame in a single plane. The winch is preferably associated with a drive means (not shown) which comprises a motor coupled on the output side to a reducing gear. The shaft 19 which drives the pulley 14 may be part of the reducing gear or be coupled thereto. The motor/reducing gear assembly is firmly attached to the frame by the rear face 12*a* thereof (FIG. 2). As is usual in lifting applications, the motor has a service brake, i.e. a mechanical brake which is normally closed at rest.

For an embodiment in the form of an autonomous winch, it will be possible to use an electric motor with which a battery will be associated. This combination forms a compact, easy to use assembly which can be carried by a user.

For user safety, the frame is covered, at least on the front face thereof, by a casing with openings for the rope 20.

Reference sign 76 indicates a lug which forms an anchoring point or a support for an anchoring point intended to receive a carabiner or other link by which a user can attach a harness, lanyard or load of some kind. Alternatively, the lug 76 may form an anchoring point for a rigid framework comprising a seat which allows the user to be seated rather than suspended from the winch. A person skilled in the art will furthermore be capable of developing any other solution to form a structure suspended from, or supported by, the present winch.

Certain preferred arrangements may also be stated.

The two deflection pulleys 24 have a stationary rotation pin 32 mounted on the frame and rotate about their respective pins 32 by means of a rolling bearing 34, for example a ball bearing. The pin 36 of the guide pulley 22 (freely rotating) is also stationary in use, but said pulley 22 is mounted retractably by means of an arm 38. The arm 38 therefore bears the guide pulley 22 at one end and is attached pivotably by the other end thereof to the frame 12. In this variant, the arm 38 is made up of a pair of connecting rods 40 which are attached by pin 42 which passes through the frame 12 and receive between them, at the opposite end, the guide pulley 22 which is supported for rotation by a pin 44 and a rolling bearing 46. Under the tension of the rope, the pivot arm 38 moves towards the grip pulley 14. A peg 43 makes it possible to limit displacement of the arm 28 to prevent the guide pulley 22 from coming into contact with the grip pulley 14. In operation, the guide pulley 22 therefore normally has a stationary position. Reference sign 48 indicates a guide part which extends from the pivot 42 of the arm 38 along part of the pulley 14.

The retracted position of the guide pulley 22 (when the peg is withdrawn and arm 38 pivoted back) is illustrated in broken lines on FIG. 1, said position facilitating placement of the rope 20.

The pressure exerted by the clamping pulley 26 on the rope 20 is preferably obtained by means of a resilient spring system 50, which makes it possible to avoid adapting the position of the pulley 26 as a function of the diameter and/or state of wear of the rope 20.

According to the present variant, the resilient spring system 50 is based on toggle or articulated lever type mechanisms. The clamping pulley 26 is mounted freely rotating at the end of a clamping arm 56 which pivots relative to the frame 12 (at the lower end of a guide part 57 attached to the frame and which extends along the grip pulley 14 on the opposite side to the guide part 48). The arm 56 comprises a pair of connecting rods 58 which are attached by a pin 60 which passes through the frame 12 and receive between them the guide pulley supported by a pin 52 and a rolling bearing 54.

Reference sign 62 indicates a connecting rod forming an actuating handle, mounted pivotably on the frame 12 about a pin 64 in the upper part of the frame. The arm 56 and the handle 62 are connected by a pair of rods 66 which extend on each side of the frame 12. At the clamping arm 56, the rod 66 is accommodated and axially locked in the rotation pin 52 of the clamping pulley 26. At the handle 62 end, the rod 66 passes through a pivot pin 68, in which it can slide axially. A compression spring 70 is provided on the end of the rods 66, beyond the pivot pin 68. The spring 70 is retained by an axial stop 72, the axial position of which may preferably be set.

Said resilient system 50 therefore makes it possible to retract the clamping pulley 26 for placement of the rope 20, the retracted position being shown in broken lines. The system 50 is locked by pivoting the handle 62 from the retracted position in the direction of the arrow 74. When the pivot pin 68 passes beyond the alignment point of pins 52 and 64, the handle 62 locks. The locking position of the handle 62, and the pressure force exerted by the clamping pulley 26 on the rope 20, may be adjusted by setting the spring force by means of the axial stop 72.

The invention claimed is:

1. A winch with a grip pulley for moving along a lifting strand, in particular a rope or cable, comprising:

a frame having, in service, an upper region facing towards a portion of the lifting strand under tension and a lower region on a slack strand side of the lifting strand;

a grip pulley mounted on the frame, the grip pulley having a groove disposed on a periphery of the grip pulley, the grip pulley enabling the lifting strand to be hauled by grip;

a guide means capable of guiding the lifting strand under tension from the upper region of the frame towards the lower region thereof, the guide means further comprising on the lower region side of the frame a guide pulley arranged below and close to said grip pulley and transferring the taut lifting strand onto the grip pulley; and a clamping pulley, arranged below the grip pulley and close to the guide pulley, exerting pressure on the lifting strand towards the grip pulley and acting on a wrapped end of the lifting strand on the grip pulley on the slack strand side;

wherein the guide pulley and the clamping pulley are positioned in such a manner that the lifting strand is engaged in said groove over an angle of at least 280°; and wherein the lifting strand exits from the grip pulley on the lower region side of the frame.

2. The winch according to claim 1, wherein the winch comprises, between the guide pulley and the clamping pulley, a guide configured to direct the slack strand downwards.

3. The winch according to claim 1, wherein the guide pulley has a rotation pin which is stationary in use.

4. The winch according to claim 3, wherein the guide pulley is mounted on a first arm which pivots relative to the frame and cooperates with a locking means for locking the first arm in use.

5. The winch according to claim 1, wherein the clamping pulley is forced towards the grip pulley by a resilient means, in particular a compression spring.

6. The winch according to claim 1, wherein the clamping pulley is carried by a second arm which is mounted pivotably on the frame about a first pin and cooperates with a toggle lever mechanism for locking the clamping pulley into a working position against the lifting strand.

7. The winch according to claim 6, wherein said second pivot arm is connected to a handle mounted pivotably on the frame about a second pin; the second pivot arm and the handle are connected by at least one connecting rod having an attachment point on the handle offset from the pivot pin thereof, to create a locking force when the handle is pivoted towards the frame and the attachment point projects beyond the alignment of the first and second pins.

8. The winch according to claim 7, wherein a compression spring is retained on the at least one connecting rod, the resilient force of which forces the handle into the locking position and the clamping pulley against the grip pulley.

9. The winch according to claim 1, wherein the guide pulley and the clamping pulley are positioned in such a manner that the lifting strand is engaged in said groove over an angle of between 300 and 340°.

10. The winch according to claim 1, wherein the aperture angle of the groove reduces with depth.

11. The winch according to claim 1, wherein the groove is defined by two sidewalls, the spacing of which gradually reduces as a function of depth, so forming a V groove.

12. The winch according to claim 1, wherein the winch exhibits a wrap coefficient of the order of 14 to 18, the grip pulley having a wrap diameter of at least 150 mm.

13. The winch according to claim 1, wherein the sidewalls of the groove have a relief pattern to provide increased grip.

14. The winch according to claim 1, wherein the frame comprises at least one anchoring point for a flexible link or a rigid structure capable of supporting a user or a load.

15. The winch according to claim 1, wherein the winch comprises rotational drive means for the grip pulley, comprising a motor coupled via a reducing gear to a rotating shaft associated with the frame and in which the grip pulley is mounted.

16. The winch according to claim 15, wherein the drive means comprise an electric motor with service brake associated with a battery.

17. The winch according to claim 1, wherein the grip pulley has a single groove.

* * * * *